US009556830B2

(12) United States Patent
Makino et al.

(10) Patent No.: US 9,556,830 B2
(45) Date of Patent: Jan. 31, 2017

(54) VAPORIZED FUEL PROCESSING APPARATUS

(71) Applicant: AISAN KOGYO KABUSHIKI KAISHA, Obu-shi, Aichi-ken (JP)

(72) Inventors: Katsuhiko Makino, Aichi-ken (JP); Junya Kimoto, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 14/847,786

(22) Filed: Sep. 8, 2015

(65) Prior Publication Data

US 2016/0076490 A1 Mar. 17, 2016

(30) Foreign Application Priority Data

Sep. 16, 2014 (JP) ..... 2014-187347

(51) Int. Cl.
*F02M 25/08* (2006.01)
*F02D 41/00* (2006.01)

(52) U.S. Cl.
CPC ..... *F02M 25/089* (2013.01); *F02D 41/003* (2013.01); *F02M 25/08* (2013.01); *F02M 25/0854* (2013.01); *F02M 2025/0881* (2013.01)

(58) Field of Classification Search
CPC F02M 25/08; F02M 25/0818; F02M 25/0836; F02M 25/0854; F02M 25/0872; F02M 25/089; F02M 2025/0881; F02D 41/003; F02D 41/0032; F02D 41/0037; F02D 41/004; F02D 41/0042; F02D 41/0045
USPC ..... 123/519, 520, 516, 518; 96/146
See application file for complete search history.

(56) References Cited

U.S. PATENT DOCUMENTS

| | | | | |
|---|---|---|---|---|
| 8,839,768 | B2 | 9/2014 | Kim et al. | |
| 9,005,350 | B2 | 4/2015 | Mani | |
| 2011/0308394 | A1* | 12/2011 | Kim | F02M 25/0836 96/146 |
| 2012/0186563 | A1 | 7/2012 | Hasegawa et al. | |
| 2013/0298878 | A1* | 11/2013 | Kim | F02M 25/0854 123/519 |
| 2013/0319249 | A1* | 12/2013 | Shinagawa | F02M 25/0854 96/146 |

FOREIGN PATENT DOCUMENTS

| | | | |
|---|---|---|---|
| JP | S61-118956 | A | 6/1986 |
| JP | 2012-102722 | A | 5/2012 |
| JP | 2012-149620 | A | 8/2012 |
| JP | 2013-217243 | A | 10/2013 |

* cited by examiner

*Primary Examiner* — Mahmoud Gimie
(74) *Attorney, Agent, or Firm* — Conley Rose, P.C.

(57) ABSTRACT

A vaporized fuel processing apparatus has a casing defining an adsorption chamber therein and having a tank port, a purge port, and an atmospheric port. The tank port is connected to a fuel tank. The purge port is connected to an internal combustion engine. The atmospheric port is open to the atmosphere. A heater is disposed between the adsorption chamber and the atmospheric port and has a fin heat exchanger and a heating element. The heating element is configured to generate heat by electricity supply. The fin heat exchanger is joined to the heating element. The surface area of the fin heat exchanger between the heating element and the adsorption chamber is larger than the surface area of the fin heat exchanger between the heating element and the atmospheric port.

20 Claims, 7 Drawing Sheets

VAPORIZED FUEL PROCESSING APPARATUS

CROSS-REFERENCE TO RELATED APPLICATIONS

This application claims priority to Japanese patent application serial number 2014-187347, filed Sep. 16, 2014, the contents of which are incorporated herein by reference in their entirety for all purposes.

STATEMENT REGARDING FEDERALLY SPONSORED RESEARCH OR DEVELOPMENT

Not applicable.

BACKGROUND

This disclosure relates to a vaporized fuel processing apparatuses having an adsorption chamber, a tank port, a purge port, an atmospheric port and a heater. The adsorption chamber is filled with an adsorbent capable of adsorbing and desorbing fuel vapor vaporized in a fuel tank. The tank port is communicated with the tank port. The purge port is configured to discharge the fuel vapor, which has been desorbed from the adsorbent, to the outside of the adsorption chamber. The atmospheric port is open to the atmosphere. The heater is disposed between the adsorption chamber and the atmospheric port.

The vaporized fuel processing apparatus, which is also referred to as "canister", is mounted on a vehicle such as automobile in order to prevent leakage of fuel vapor, which has been vaporized in a fuel tank, to the outside of the vehicle. In detail, the fuel vapor, which has been vaporized in the fuel tank, flows into the adsorption chamber via the tank port and is selectively adsorbed into the adsorbent disposed in the adsorption chamber. However, the adsorbent has an adsorption capacity for the fuel vapor and cannot adsorb the fuel vapor over this adsorption capacity. Thus, it is necessary to periodically desorb the fuel vapor from the adsorbent in order to recover adsorption ability of the adsorbent. Accordingly, an atmospheric air is introduced into the adsorption chamber via the atmospheric port as purge air due to negative pressure in an intake pipe connected to an internal combustion engine and the like in order to desorb the fuel vapor from the adsorbent. The desorbed fuel vapor is discharged to the outside of the adsorption chamber via the purge port.

The adsorbent has a characteristic that the higher the temperature is, the lower the adsorption capacity for the fuel vapor is, and that the lower the temperature is, the higher the adsorption capacity for the fuel vapor is. Thus, when desorbing the fuel vapor from the adsorbent, the higher the temperature is, the larger the desorption amount of the fuel vapor is, and the lower the temperature is, the smaller the desorption amount of the fuel vapor is. Accordingly, when desorbing the fuel vapor from the adsorbent, it is preferable that the temperature is as high as possible in order to improve desorbing efficiency (recovery efficiency of the adsorbent). However, when desorbing the fuel vapor from the adsorbent, the temperature of the adsorbent tends to decrease due to heat of vaporization of the fuel vapor. Thus, the desorbing efficiency can be improved by providing a heater at the upstream of the adsorption chamber and heating the purge air.

Japanese Laid-Open Patent Publication No. 2012-102722 discloses a vaporized fuel processing apparatus having a heater for heating purge air. The heater has a heating element, which generates heat by electricity supply, and a fin heat exchanger, which is joined to the heating element and extends from the heating element both to the tank port side and to the adsorption chamber side. With respect to the heater, the heating element is positioned at a center of the fin heat exchanger with respect to a flowing direction of the purge air. The fin heat exchanger has a plurality of fins arranged in parallel to each other at regular intervals.

In the vaporized fuel processing apparatus of Japanese Laid-Open Patent Publication No. 2012-102722, a diffusion plate having a plurality of diffusion holes is provided between the heater and the atmospheric port in order to radially diffuse the purge air introduced from the atmospheric port and to uniformly supply the purge air to the entire heater. The diffusion holes of the diffusion plate are arranged such that the opening area of the diffusion holes at the center area just below the atmospheric port is the smallest, and such that the opening area of the diffusion holes gradually increases from the center area toward a circumferential edge of the diffusion plate.

The purge air is introduced from the atmospheric port via the heater into the adsorption chamber. Thus, with respect to the flowing direction of the purge air, heat exchange efficiency upstream of the heating element is lower than heat exchange efficiency downstream of the heating element. That is, the heat exchange efficiency by a part of the fin heat exchanger, which extends from the heating element to the atmospheric port side, is lower than the heat exchange efficiency by another part of the fin heat exchanger, which extends from the heating element to the adsorption chamber side. Accordingly, at the upstream of the heating element, the fin heat exchanger cannot exert its maximum performance. In the case of the vaporized fuel processing apparatus disclosed in Japanese Laid-Open Patent Publication No. 2012-102722, because the heating element is positioned at the center of the fin heat exchangers with respect to the flowing direction of the purge air, heating of the purge air by the heater is inefficient. Further, this decreases the space efficiency for the fin heat exchangers.

Sometimes, the canister is horizontally disposed such that a flow passage for gas within the adsorption chamber extends horizontally. In this case, because the specific gravity of the fuel vapor is heavier than that of air, the adsorption amount of the fuel vapor at a lower area within the adsorption chamber tends to be large. Thus, when the canister is disposed horizontally, it is preferable that the heating efficiency of the purge air by the heater increases toward the bottom. In the case of the vaporized fuel processing apparatus disclosed in Japanese Laid-Open Patent Publication No. 2012-102722, the fins of the fin heat exchanger are arranged at regular intervals, so that it would be difficult to preferentially heat a lower area within the adsorption chamber.

Sometimes, the atmospheric port is formed at a position eccentric relative to the center of the adsorption chamber in the radial direction at an end of the adsorption chamber facing the atmospheric port. In the case of the diffusion plate disclosed in Japanese Laid-Open Patent Publication No. 2012-102722, because the opening area at the center is the smallest, the position of a portion having the smallest opening area of the diffusion plate is deviated from the position of the atmospheric port in the radial direction. This cannot uniformly supply the purge air to the heater, so that the desorbing efficiency is low.

When the canister traps the fuel vapor generated in the fuel tank, gas flows within the adsorption chamber from the tank port toward the atmospheric port. Thus, the fuel vapor concentration in the gas flowing through the adsorption chamber decreases from the tank port toward the atmospheric port. Accordingly, the adsorbing efficiency for the fuel vapor decreases toward the atmospheric port. In the case of the vaporized fuel processing apparatus disclosed in Japanese Laid-Open Patent Publication No. 2012-102722, the adsorption chamber is divided into a plurality of compartments, and the compartments are filled with the same adsorption material. Therefore, there has been a need for improved vaporized fuel processing apparatuses.

BRIEF SUMMARY

In one aspect of this disclosure, a vaporized fuel processing apparatus has a casing defining an adsorption chamber therein and having a tank port, a purge port and an atmospheric port. The tank port is connected to a fuel tank. The purge port is connected to an internal combustion engine. The atmospheric port is open to the atmosphere. A heater is disposed between the adsorption chamber and the atmospheric port and has a fin heat exchanger and a heating element. The heating element is configured to generate heat by electricity supply. The fin heat exchanger is joined to the heating element. The surface area of the fin heat exchanger between the heating element and the adsorption chamber is larger than the surface area of the fin heat exchanger between the heating element and the atmospheric port.

According to this aspect of the disclosure, because, with respect to a flowing direction of the purge air, the surface area of the fin heat exchanger downstream of the heating element is larger than the surface area of the fin heat exchanger upstream of the heating element, the heating efficiency of the purge air by the heater can be improved. As a result, the desorption efficiency of the fuel vapor from an adsorbent can be improved.

In another aspect of this disclosure, when the vaporized fuel processing apparatus is mounted on a vehicle such that a gas flow passage within the adsorption chamber between the atmospheric port and the purge port horizontally extends, the surface area of the fin heat exchanger can be configured to increase toward a lower end of the heater.

According to this aspect of the disclosure, the heating efficiency of the purge air in the heater increases toward the lower end of the heater. Because the specific gravity of the fuel vapor is heavier than that of air, the adsorption amount of the fuel vapor at a lower area within the adsorption chamber tends to be large. Thus, the desorption efficiency of the fuel vapor from the adsorbent can be improved.

In another aspect of this disclosure, a diffusion plate having a plurality of diffusion holes can be provided between the heater and the atmospheric port for diffusing the purge air. When the atmospheric port is formed at a position eccentric relative to the central axis of the adsorption chamber in the radial direction, the diffusion holes are formed such that the opening area of the diffusion holes just below the atmospheric port is the smallest and such that the opening area of the diffusion holes gradually increases toward a circumferential edge of the diffusion plate.

According to this aspect of the disclosure, it is able to uniformly supply the purge air to the entire heater depending on the atmospheric port. Therefore, the desorption efficiency of the fuel vapor from the adsorbent can be improved.

In another aspect of this disclosure, the adsorption chamber facing to the atmospheric port can be divided into a plurality of compartments, which includes a first compartment facing the atmospheric port. The first compartment is filled with a first adsorbent having a higher adsorption capacity than a second adsorbent filled in the other compartments.

According to this aspect of the disclosure, when gas containing a low level of the fuel vapor flows into the first compartment, the first adsorbent better adsorbs the fuel vapor.

DETAILED DESCRIPTION

Each of the additional features and teachings disclosed above and below may be utilized separately or in conjunction with other features and teachings to provide improved vaporized fuel processing apparatuses. Representative examples, which utilize many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary in the broadest sense, and are instead taught merely to particularly describe representative examples. Moreover, various features of the representative examples and the dependent claims may be combined in ways that are not specifically enumerated in order to provide additional useful embodiments of the present teachings.

Figure 1:
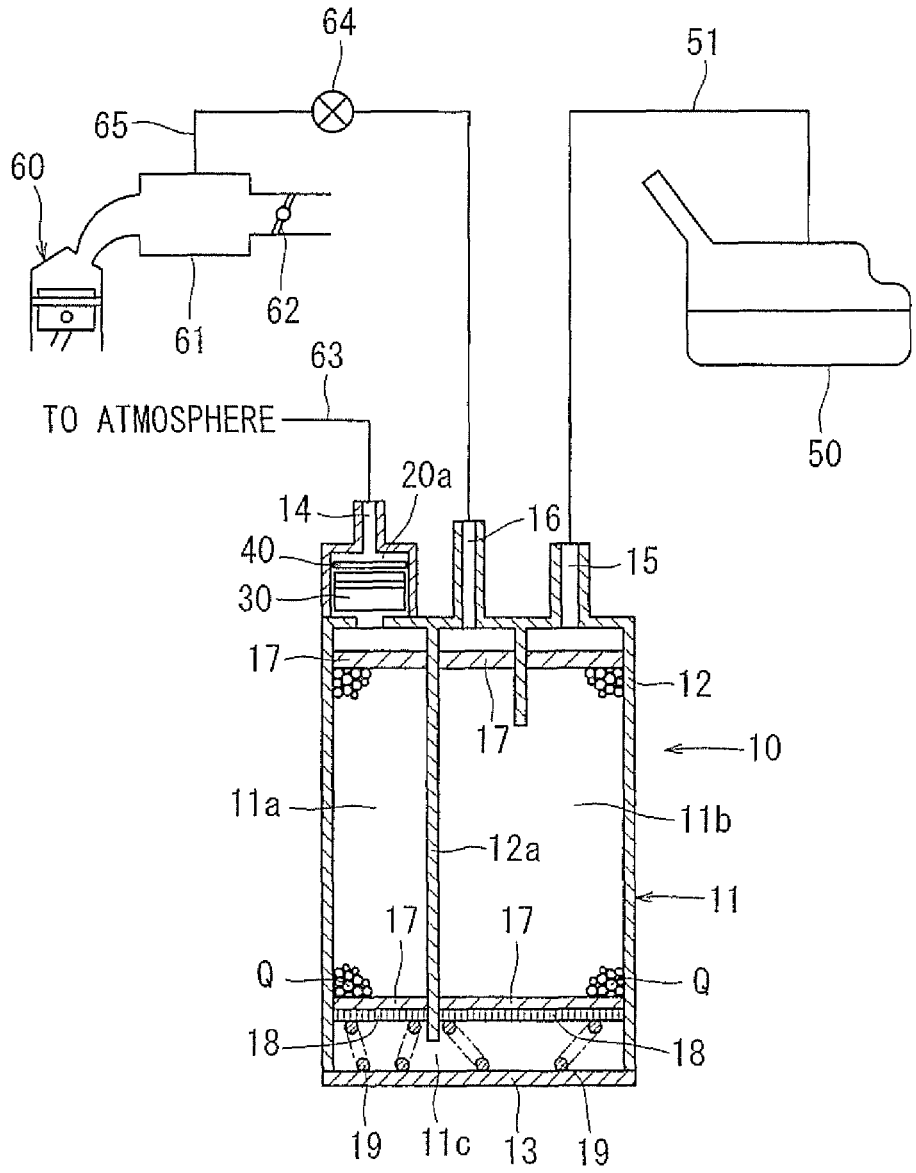
FIG. 1 is a schematic view of a vaporized fuel processing apparatus and its surroundings.

A canister 10 has a case 11 as shown in FIG. 1. The case 11 is made from resin material and is composed of a case body 12 and a lid 13. The case body 12 is formed in a hollow rectangular cylindrical shape having a closed end and an open end. The lid 13 is configured to close the open end of the case body 12. An inner space of the case 11 (the case body 12) is divided into a first adsorption chamber 11*a* and a second adsorption chamber 11*b* by a partition wall 12*a*. A communication passage 11*c* is formed between the case body 12 and the lid 13 such that the first adsorption chamber 11*a* and the second adsorption chamber 11*b* are communicated with each other via the communication passage 11*c*. Thus, the first adsorption chamber 11*a*, the communication passage 11*c* and the second adsorption chamber 11*b* define a U-shaped gas flowing passage in the canister 10. In this embodiment, it is premised that the canister 10 is vertically mounted.

An atmospheric port 14, a tank port 15 and a purge port 16 are formed at the closed end of the case body 12. The atmospheric port 14 is communicated with the first adsorption chamber 11*a*. The tank port 15 and the purge port 16 are communicated with the second adsorption chamber 11*b*. The tank port 15 is communicated with a gaseous layer within a fuel tank 50 via a fuel vapor passage 51. The purge port 16 is communicated with an air intake pipe 61 of an internal combustion engine 60 via a purge passage 65. A throttle valve 62 controls the amount of air flowing into the internal combustion engine 60. The purge passage 65 is connected to the air intake pipe 61 downstream of the throttle valve 62. The purge passage 65 is provided with a purge valve 64 for closing the purge passage 65. While the internal combustion engine 60 is running, an electric control unit (ECU, not shown) controls the purge valve 64 in order to execute purge control. The atmospheric port 14 is open to the atmosphere via an atmospheric passage 63.

Both ends of the first adsorption chamber 11*a* and both ends of the second adsorption chamber 11*b* are provided with filters 17, respectively. With respect to the filters 17 on the lid 13 side, a porous plate 18 is disposed along an outer surface of each filter 17. Further, a coil spring 19 is provided between the lid 13 and each porous plate 18. The coil springs 19 press the porous plates 18 toward the first adsorption chamber 11*a* and the second adsorption chamber 11*b*, respectively. The filters 17 are made of non-woven fabric made from resin material, sponge such as foamed urethane or the like.

The adsorption chamber 11*a* and the second adsorption chamber 11*b* are filled with an adsorbent Q capable of selectively adsorbing and desorbing fuel vapor such as butane. For example, the adsorbent Q can be composed of granular activated carbon. The granular activated carbon can be composed of crushed and/or extruded activated carbon, which is made by shaping granular activated carbon or powder activated carbon with a binder, or the like. The butane working capacity (BWC) of the adsorbent Q, based on the relevant American Society for Testing and Materials (ASTM) method, is not limited in this disclosure and may be lower than 13 g/dL.

Figure 2:
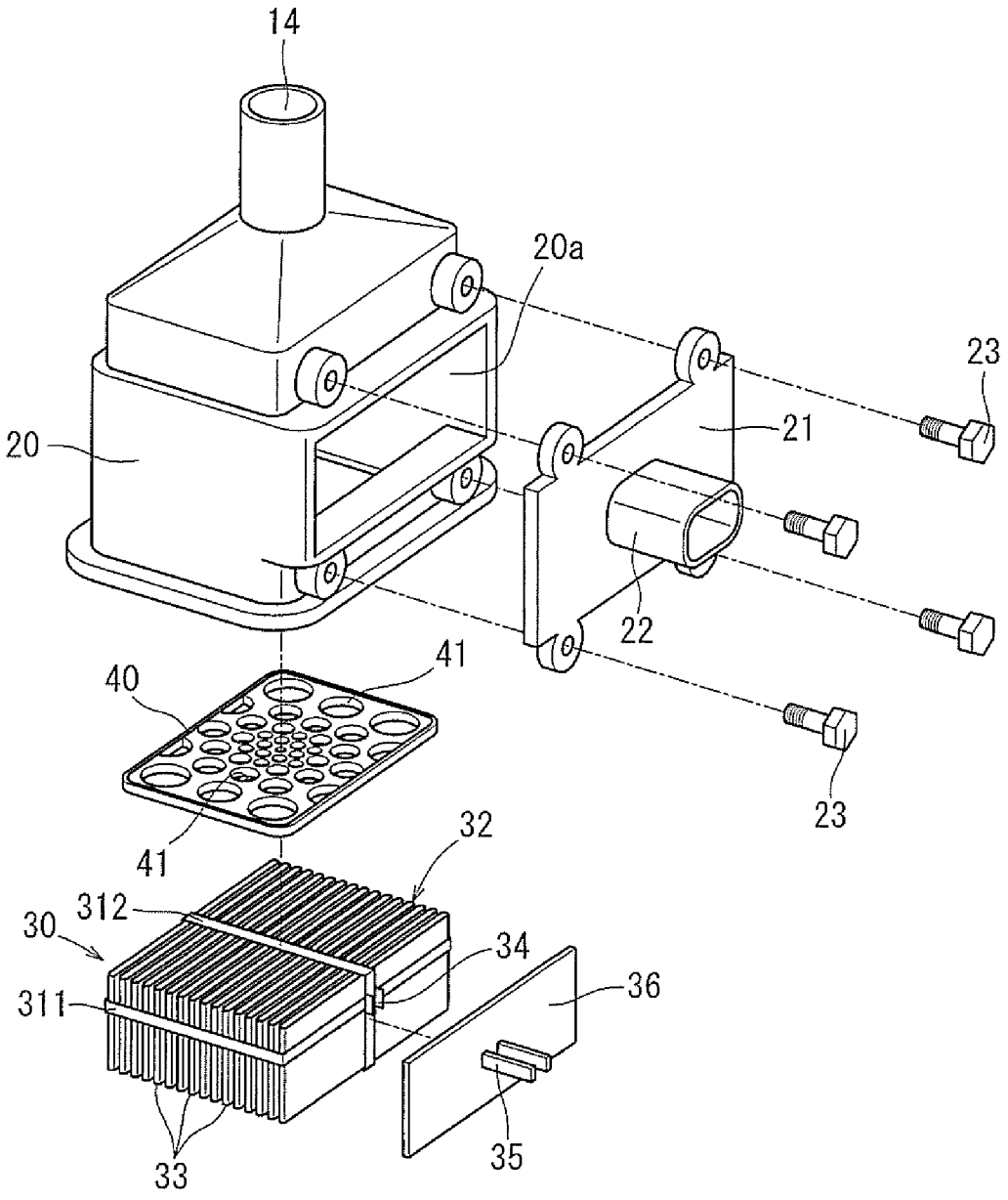
FIG. 2 is an exploded view of a part of the vaporized fuel processing apparatus.

The canister 10 has a heating chamber 20*a* between the first adsorption chamber 11*a* and the atmospheric port 14. A heater 30 and a diffusion plate 40 are provided in the heating chamber 20*a*. The heater 30 is configured to heat the purge gas. The diffusion plate 40 is configured to diffuse the purge gas flowing toward the heater 30. As shown in FIG. 2, the heating chamber 20*a* is defined by a heater case 20. The heater case 20 is formed based on the shape of the heater 30 and the shape of the diffusion plate 40 and has an opening at one side wall for moving the heater 30 and the diffusion plate 40 into and out of the heating chamber 20*a*. Usually, a cover 21 having a connector 22 is fixed on the heater case 20 by screws 23 in order to close the opening.

Figure 3:
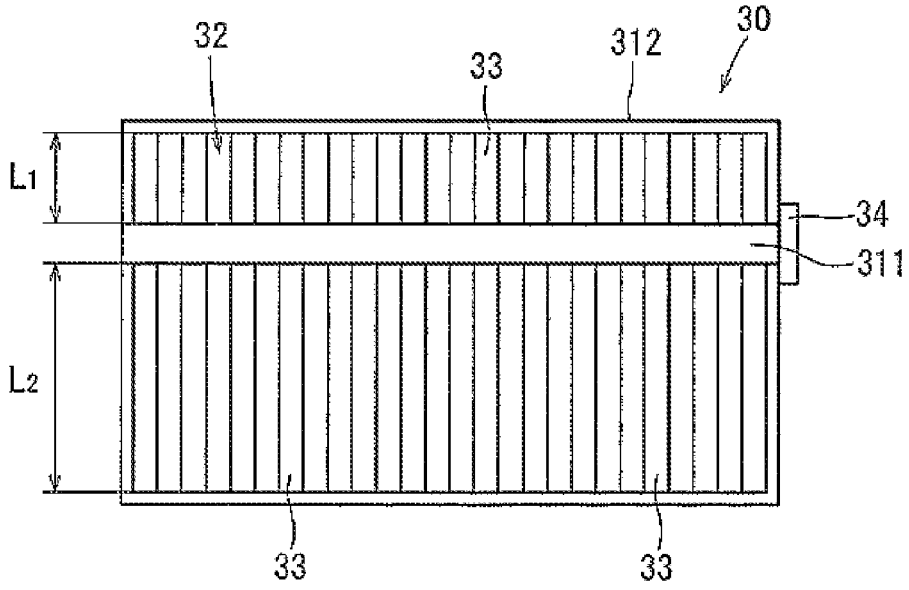
FIG. 3 is a side view of a heater.

As shown in FIG. 3, the heater 30 has heating elements 311, 312 generating heat by electricity supply and a fin heat exchanger 32 joined to the heating elements 311 and 312. The fin heat exchanger 32 is made from metal having high thermal conductivity and has a plurality of thin fins 33 arranged parallel to each other in a surface matching manner. Each of the heating elements 311 and 312 is composed of a band-shaped material having a positive temperature coefficient (PTC) characteristic. The heating element 311 is wound around the fin heat exchanger 32 once in a direction perpendicular to the flowing direction of the purge gas, that is, along four side surfaces of the fin heat exchanger 32 shown in FIG. 2. The heating element 312 is wound around the fin heat exchanger 32 once in a direction parallel to the flowing direction of the purge gas, that is, along an upper surface, a right surface, a lower surface and a left surface of the fin heat exchanger shown in FIG. 3. In addition, the heating elements 311 and 312 are attached to the outer surface of the fin heat exchanger 32 with an adhesive.

Figure 5:
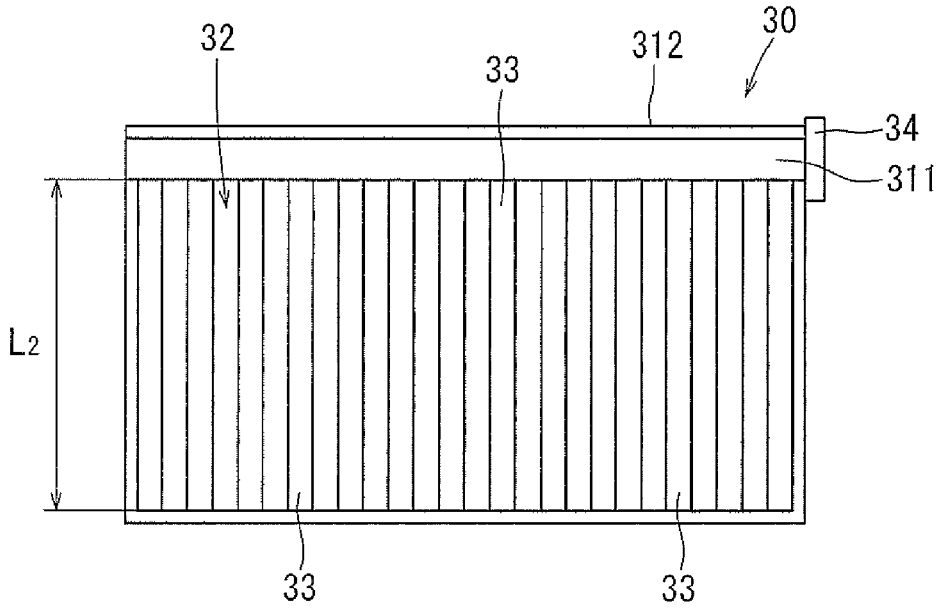
FIG. 5 is a side view of a heater having a heating element at its upper end.

With respect to the flowing direction of the purge gas, the fin heat exchanger 32 extends both upstream and downstream of the heating element 311, that is, both between the heating element 311 and the atmospheric port 14 and between the heating element 311 and the first adsorption chamber 11*a* (see FIG. 1). Here, on the outer surface of the fin heat exchanger 32, the heating element 311 is disposed at an upstream side of the flowing direction of the purge gas, that is, is provided at a position closer to the atmospheric port 14. Thus, the vertical length $L_1$ of the fin heat exchanger 32 extending from the heating element 311 toward the atmospheric port 14 is shorter than the vertical length $L_2$ of the fin heat exchanger 32 extending from the heating element 311 toward the first adsorption chamber 11*a* ($L_1<L_2$). Accordingly, the surface area of the fin heat exchanger 32 from the heating element 311 on the first adsorption chamber 11*a* side is larger than the surface area of the fin heat exchanger 32 from the heating element 311 on the atmospheric port 14 side. Further, as shown in FIG. 5, the heating element 311 can be positioned at an upper end of the fin heat exchanger 32. In such case, the fin heat exchanger 32 extends only between the heating element 311 and the first adsorption chamber 11*a*.

Figure 8:
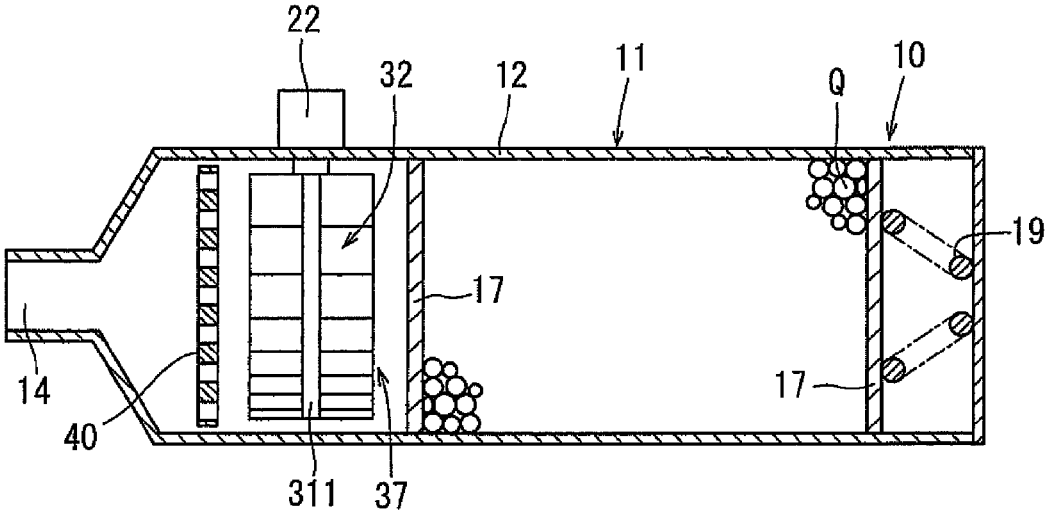
FIG. 8 is a cross-sectional side view of a horizontally-mounted type canister.
Figure 9:
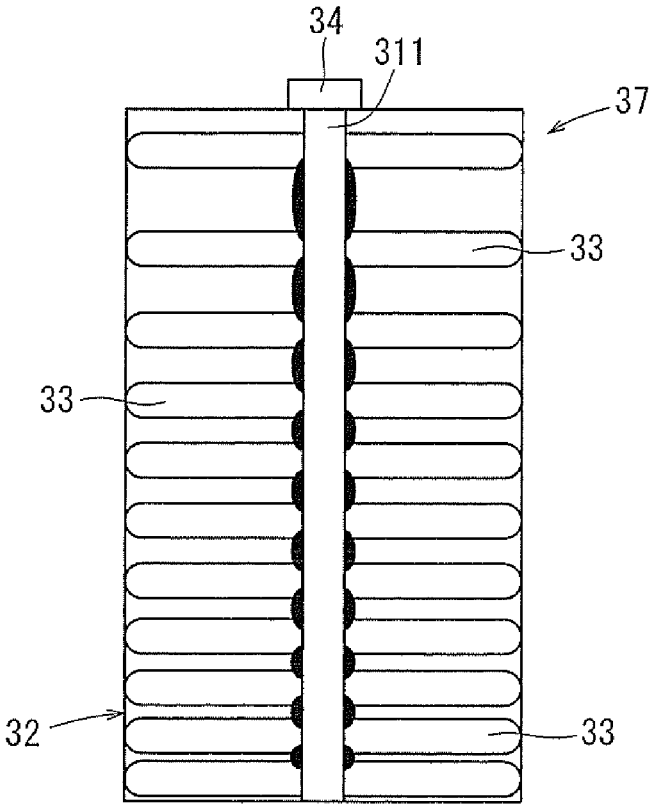
FIG. 9 is a front view of a heater shown in FIG. 8.

As shown in FIG. 8, the canister 10 can be horizontally mounted such that the gas flowing passage within the adsorption chamber horizontally extends. In such case, it is preferable that the surface area of the fin heat exchanger 32 increases toward the bottom. Thus, as shown in FIG. 9, a heater 37 can have a plurality of the fins 33 arranged so that the intervals of the fins 33 in the vertical direction are narrowed from an upper portion of the heater 37 toward a lower portion.

As shown in FIG. 2, the heating elements 311 and 312 are provided with an electrode 34, which is connected to a printed circuit board (PCB) 36 having a connector pin 35. When the heater 30 is disposed within the heating chamber 20*a*, the connector pin 35 is inserted into the connector 22 of the cover 21 such that the flowing direction of the purge gas is parallel to the surfaces of each fin 33. Here, the ECU controls electricity supply to the heating elements 311 and 312 via the connector pin 35 and electrode 34 thereby resulting in heating by the heater 30.

The diffusion plate 40 is disposed upstream of the heater 30 with respect to the flowing direction of the purge gas, that is, between the heater 30 and the atmospheric port 14. A plurality of diffusion holes 41 are formed throughout the diffusion plate 40. The atmospheric port 14 is formed at a position corresponding to a center of the first adsorption chamber in the radial direction as shown in FIG. 1. Thus, the diffusion holes 41 of the diffusion plate 40 are formed such that the opening area per unit area at the center of the diffusion plate 40, which is positioned just below the atmospheric port 14, is the smallest and such that the opening area per unit area gradually increases from the center toward a circumferential edge of the diffusion plate 40.

Figure 4:
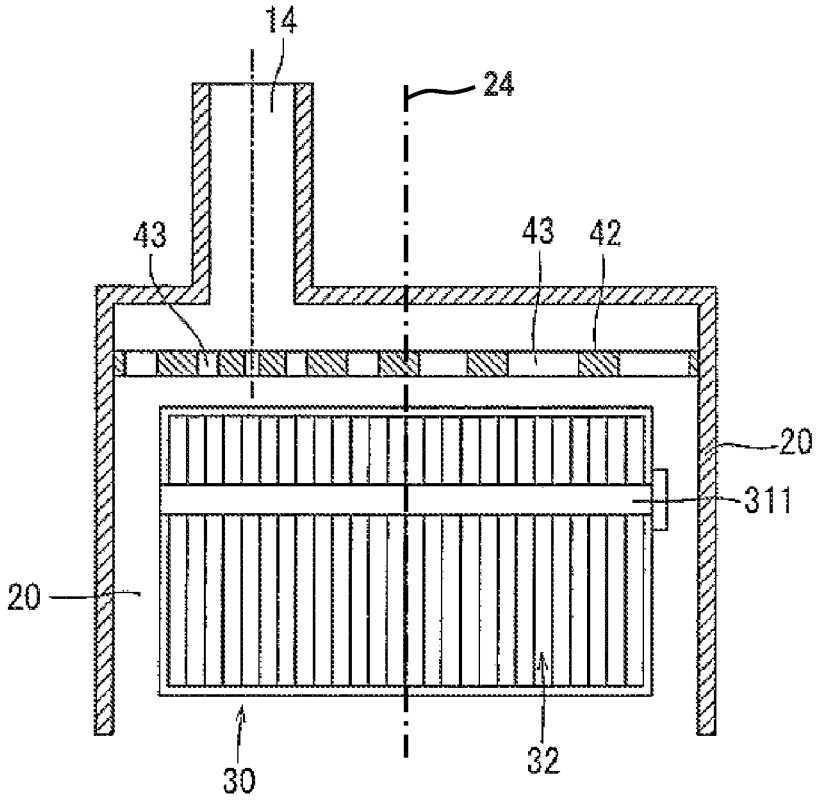
FIG. 4 is a cross-sectional view of an eccentric atmospheric port and its surroundings.
Figure 6:
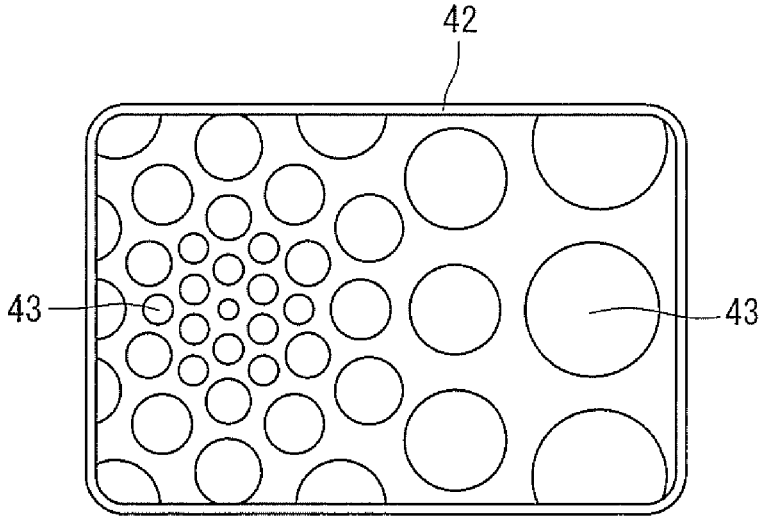
FIG. 6 is a plan view of an eccentric diffusion plate.
Figure 7:
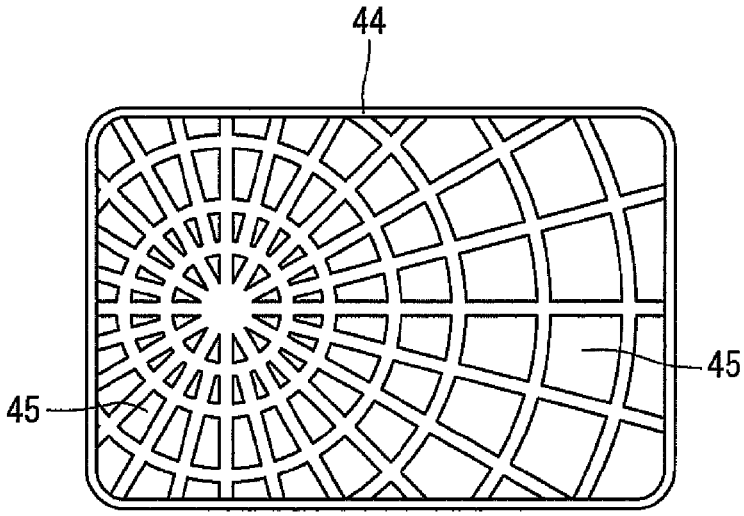
FIG. 7 is a plan view of another eccentric diffusion plate.

On the other hand, as shown in FIG. 4, the atmospheric port 14 can be formed at a position eccentric relative to the center of the first adsorption chamber 11*a* in the radial direction (i.e., the atmospheric port 14 is eccentric relative to a central axis 24 of first adsorption chamber 11*a*). In this case, as shown in FIG. 6, a diffusion plate 42 having a plurality of diffusion holes 43 can be used. The diffusion holes 43 are formed throughout the diffusion plate 42 such that the opening area of the diffusion holes 43 is not the smallest at the center, is the smallest at a position just under the eccentric atmospheric port 14 and gradually increases toward a circumferential edge of the diffusion plate 42. Thus, it is able to uniformly supply the purge air to the heater 30 based on the position of the atmospheric port 14. Here, various diffusion plates can be used instead of the diffusion chamber 42 having the circular diffusion holes 43 shown in FIG. 6. For example, at least some embodiments may use a diffusion plate 44 having curved frames and straight frames radially extending such that the frames define diffusion holes 45 as shown in FIG. 7. In a case of the diffusion chamber 40 where the opening area of the diffusion holes 41 at the center is the smallest, the shapes of the diffusion holes 41 can be changed, for example, as the diffusion holes 45.

Next, the working of the canister 10 will be described in reference to FIG. 1. During fueling or parking, fuel vapor gas, which contains fuel vapor generated in the fuel tank 50, is introduced into the second adsorption chamber 11*b* via the tank port 15 of the canister 10 and then flows through the communication passage 11*c* and the first adsorption chamber 11*a* toward the atmospheric port 14 such that the fuel vapor gas goes around the partition wall 12*a*. While the fuel vapor gas flows through the second adsorption chamber 11*b* and the first adsorption chamber 11*a*, the fuel vapor included in the fuel vapor gas is selectively adsorbed into the adsorbent Q filled in the second adsorption chamber 11*b* and the first adsorption chamber 11*a*. And, the remaining fuel vapor gas, which has passed through the first adsorption chamber 11*a* without adsorbing on the adsorbent Q and substantially corresponds to atmospheric components, flows from the atmospheric port 14 into the atmosphere via the atmospheric passage 63.

When the ECU opens the purge valve 64 while the internal combustion engine 60 is running, negative pressure in the air intake pipe 61 is applied to the first and second adsorption chambers 11*a* and 11*b* via the purge port 16. Thus, the atmospheric air flows through the atmospheric passage 63 and the atmospheric port 14 into the canister 10 as purge air, so that the fuel vapor is desorbed from the adsorbent Q. At this time, the heating elements 311 and 312 are supplied with electricity simultaneously with opening of the purge valve 64 in order to operate the heater 30. Accordingly, the purge air passing through the atmospheric port 14 is heated in the heating chamber 20*a*, so that the heated purge air flows into the first and second adsorption chambers 11*a* and 11*b*. As a result, the desorbing efficiency of the fuel vapor can be improved.

When the purge air flows into the heating chamber 20*a* from the atmospheric port 14, the purge air collides with the diffusion plate 40 and diffuses in the radial direction. In the diffusion plate 40, the opening area of the diffusion holes 41 is the smallest at the position just below the atmospheric port 14 and gradually increases toward the circumferential edge of the diffusion plate 40. Thus, the amount of the purge air flowing through each diffusion hole 41 is adjusted such that the purge air is uniformly supplied to the entire heater 30 in order to improve the heating efficiency by the heater 30. In the heater 30, the heating elements 311 and 312 generate heat by electricity supply, and the resulting heat is transferred to the fin heat exchanger 32. When the purge air that has passed through the diffusion plate 40 is supplied to the heater 30, the purge air is heated as it flows between the fins 33. Because the surface area of the fin heat exchanger 32 downstream of the heating element 311 is larger than the surface area of the fin heat exchanger 32 upstream of the heating element 311, the heater 30 can effectively heat the purge air.

Then, purge gas containing the purge air and the fuel vapor desorbed from the adsorbent Q is discharged from the purge port 16 and is introduced into the internal combustion engine 60 via the purge passage 65. Here, the fuel vapor desorbed from the adsorbent Q can be returned to the fuel tank 50 by providing a suction means such as vacuum pump on the purge passage 65.

Figure 10:
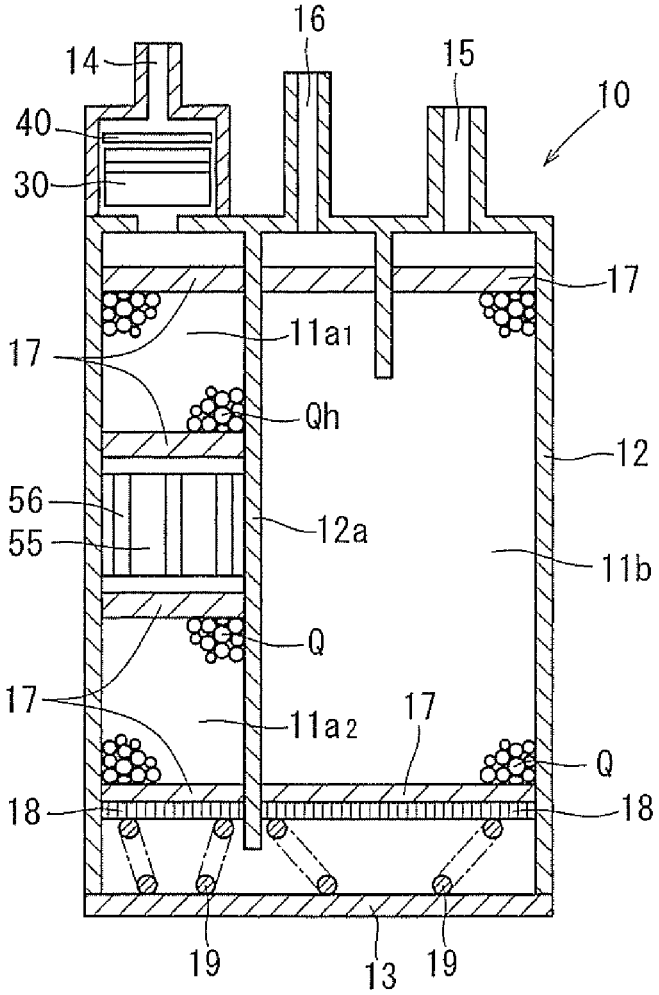
FIG. 10 is a cross-sectional view of a canister having an air compartment.

As shown in FIG. 10, the first adsorption chamber 11*a* can be divided into a plurality compartments including an air compartment 55 such that the air compartment 55 is positioned between the other compartments. In detail, the first adsorption chamber 11*a* can be divided into the air compartment 55, a first compartment $\mathbf{11}_{a1}$ and a second compartment $\mathbf{11}_{a2}$ such that, in the flowing direction of the purge air, the first compartment $\mathbf{11}_{a1}$ is positioned upstream of the air compartment 55, and the second compartment $\mathbf{11}_{a2}$ is positioned downstream of the air compartment 55. The filters 17 are provided at both ends of the first compartment $\mathbf{11}_{a1}$ and at both ends of the second compartment $\mathbf{11}_{a2}$, respectively. The filters 17 closer to the air compartment 55 are supported by a support member 56 disposed in the air compartment 55. It is preferable that the first compartment $\mathbf{11}_{a1}$ near the atmospheric port 14 is filled with an adsorbent Qh having higher adsorption capacity than the adsorbent Q filled in the second compartment $\mathbf{11}_{a2}$. The adsorbent Qh can be composed of an adsorbent having a peak between 1.8-2.2 mm in a fine pore diameter distribution. Further, it is preferable that the butane working capacity of the adsorbent Qh based on the ASTM method is equal to or higher than 13 g/dL. In such case, when the fuel vapor gas flows into the canister 10 via the tank port 15, most of the fuel vapor is adsorbed on the adsorbent Q filled in the second adsorption chamber 11*b* and the second compartment $\mathbf{11}_{a2}$. Thus, the fuel vapor gas containing a low level of the fuel vapor flows into the first compartment $\mathbf{11}_{a1}$. Because the adsorbent Qh can certainly trap the low-concentrated fuel vapor, the adsorption efficiency of the fuel vapor can be improved. The adsorbent having the high adsorption capacity has a high adsorption power for the fuel vapor, and thus the desorption of the fuel vapor from the adsorbent by the purge operation is inefficient. Thus, in general, the adsorbent having the high adsorption capacity is not preferable. However, because the desorption efficiency is improved by the heater 30 disposed between the first compartment $\mathbf{11}_{a1}$ and the atmospheric port 14, the adsorbent having the high adsorption capacity can be used as the adsorbent Qh.

The invention claimed is:

1. A vaporized fuel processing apparatus comprising:

a casing defining an adsorption chamber therein and having a tank port, a purge port, and an atmospheric port, the tank port being connected to a fuel tank, the purge port being connected to an internal combustion engine, and the atmospheric port being open to the atmosphere; and a heater disposed between the adsorption chamber and the atmospheric port, wherein the heater includes a fin heat exchanger and a first heating element, the first heating element being configured to generate heat by electricity supply, and the fin heat exchanger being joined to the first heating element;

wherein the first heating element is a band-shaped member that is wound around the fin heat exchanger such that the fin heat exchanger extends both between the first heating element and the atmospheric port and between the first heating element and the adsorption chamber; and wherein a surface area of the fin heat exchanger between the first heating element and the adsorption chamber is larger than a surface area of the fin heat exchanger between the first heating element and the atmospheric port.

2. The vaporized fuel processing apparatus according to claim 1, wherein the adsorption chamber is divided into a plurality of compartments including a first compartment facing the atmospheric port; and wherein a first adsorbent filled in the first compartment has a higher adsorption capacity than a second adsorbent filled in the other compartments.

3. The vaporized fuel processing apparatus according to claim 2, wherein the first adsorbent has a peak between 1.8 and 2.2 mm in a fine pore diameter distribution.

4. The vaporized fuel processing apparatus according to claim 2, wherein a butane working capacity of the first adsorbent is equal to or higher than 13 g/dL.

5. The vaporized fuel processing apparatus according to claim 2, wherein the plurality of compartments includes an air compartment disposed between the first compartment and another of the compartments.

6. The vaporized fuel processing apparatus according to claim 2, wherein the casing has a partition wall such that a U-shaped flow passage is formed in the adsorption chamber.

7. The vaporized fuel processing apparatus according to claim 1, further comprising a second heating element configured to generate heat by electricity supply;

wherein the second heating element is a band-shaped member that is wound around the fin heat exchanger in a direction that is parallel to a flowing direction of a purge gas across the heater; and wherein the first heating element is wound around the fin heat exchanger in a direction that is perpendicular to the flowing direction of the purge gas across the heater.

8. A vaporized fuel processing apparatus comprising:

a casing defining an adsorption chamber therein and having a tank port, a purge port, and an atmospheric port, the tank port being connected to a fuel tank, the purge port being connected to an internal combustion engine, and the atmospheric port being open to the atmosphere; and a heater disposed between the adsorption chamber and the atmospheric port, wherein the heater includes a fin heat exchanger and a heating element, the heating element being configured to generate heat by electricity supply, and the fin heat exchanger being joined to the heating element;

wherein the vaporized fuel processing apparatus is mounted on a vehicle such that a gas flow passage within the adsorption chamber from the atmospheric port to the purge port extends horizontally; and wherein a surface area of the fin heat exchanger increases toward a lower end of the heater.

9. The vaporized fuel processing apparatus according to claim 8, wherein the fin heat exchanger has a plurality of fins arranged parallel to each other; and wherein the intervals between the fins are narrowed toward the lower end of the heater.

10. The vaporized fuel processing apparatus according to claim 8, wherein the adsorption chamber is divided into a plurality of compartments including a first compartment facing the atmospheric port; and wherein a first adsorbent filled in the first compartment has a higher adsorption capacity than a second adsorbent filled in the other compartments.

11. The vaporized fuel processing apparatus according to claim 10, wherein the first adsorbent has a peak between 1.8 and 2.2 mm in a fine pore diameter distribution.

12. The vaporized fuel processing apparatus according to claim 10, wherein a butane working capacity of the first adsorbent is equal to or higher than 13 g/dL.

13. The vaporized fuel processing apparatus according to claim 10, wherein the plurality of compartments includes an air compartment disposed between the first compartment and another of the compartments.

14. The vaporized fuel processing apparatus according to claim 10, wherein the casing has a partition wall such that a U-shaped flow passage is formed in the adsorption chamber.

15. A vaporized fuel processing apparatus comprising:

a casing defining an adsorption chamber therein and having a tank port, a purge port, and an atmospheric port, the adsorption chamber having a central axis that extends vertically, the tank port being connected to a fuel tank, the purge port being connected to an internal combustion engine, and the atmospheric port being open to the atmosphere and facing the adsorption chamber;

a heater disposed between the adsorption chamber and the atmospheric port; and a diffusion plate disposed above the heater and below the atmospheric port and having a plurality of diffusion holes;

wherein the atmospheric port is formed at a position eccentric relative to the central axis of the adsorption chamber in the radial direction; and wherein an opening area of the diffusion holes in the diffusion plate gradually increases from an area just below the atmospheric port toward a circumferential edge of the diffusion plate.

16. The vaporized fuel processing apparatus according to claim 15, wherein the adsorption chamber is divided into a plurality of compartments including a first compartment facing the atmospheric port; and wherein a first adsorbent filled in the first compartment has a higher adsorption capacity than a second adsorbent filled in the other compartments.

17. The vaporized fuel processing apparatus according to claim 16, wherein the first adsorbent has a peak between 1.8 and 2.2 mm in a fine pore diameter distribution.

18. The vaporized fuel processing apparatus according to claim 16, wherein a butane working capacity of the first adsorbent is equal to or higher than 13 g/dL.

19. The vaporized fuel processing apparatus according to claim 16, wherein the plurality of compartments includes an air compartment disposed between the first compartment and another of the compartments.

20. The vaporized fuel processing apparatus according to claim 16, wherein the casing has a partition wall such that a U-shaped flow passage is formed in the adsorption chamber.

* * * * *